US009693396B2

(12) United States Patent
Jeanneteau et al.

(10) Patent No.: US 9,693,396 B2
(45) Date of Patent: Jun. 27, 2017

(54) INDUCTION HOB AND A METHOD FOR CONTROLLING AN INDUCTION HOB

(75) Inventors: Laurent Jeanneteau, Compiegne (FR); Thibaut Rigolle, Forli (IT); Massimo Zangoli, Santarcangelo di Romagna (IT); Svend Erik Christiansen, Faenza (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1152 days.

(21) Appl. No.: 13/496,273

(22) PCT Filed: Nov. 25, 2010

(86) PCT No.: PCT/EP2010/007145
§ 371 (c)(1),
(2), (4) Date: Aug. 27, 2012

(87) PCT Pub. No.: WO2011/063954
PCT Pub. Date: Jun. 3, 2011

(65) Prior Publication Data

US 2012/0312803 A1 Dec. 13, 2012

(30) Foreign Application Priority Data

Nov. 27, 2009 (EP) ..... 09014767

(51) Int. Cl.
*H05B 6/12* (2006.01)
*H05B 6/04* (2006.01)
*H05B 6/06* (2006.01)

(52) U.S. Cl.
CPC ..... *H05B 6/065* (2013.01); *H05B 2213/03* (2013.01)

(58) Field of Classification Search
CPC .. H05B 6/065; H05B 2213/03; H05B 6/1209; H05B 6/062; H05B 2206/022
(Continued)

(56) References Cited

U.S. PATENT DOCUMENTS 2,689,900 A * 9/1954 Redmond ..... H05B 6/04 219/640
3,781,503 A * 12/1973 Harnden et al. ..... 219/622
(Continued)

FOREIGN PATENT DOCUMENTS

| | | |
|---|---|---|
| DE | 102004003126 | 8/2005 |
| EP | 1951003 | 7/2008 |
| EP | 2007174 | 12/2008 |

OTHER PUBLICATIONS

International Search Report for PCT/EP2010/007145, dated Mar. 17, 2011, 3 pages.

*Primary Examiner* — David Angwin
*Assistant Examiner* — Gyounghyun Bae
(74) *Attorney, Agent, or Firm* — Pearne & Gordon, LLP

(57) ABSTRACT

The present invention relates to an induction hob with a cooking surface (10) and a number of induction coils (12; 16, 18) within said cooking surface (10). The induction coils (12; 16, 18) are arranged on the cooking surface (10) according to predetermined scheme, so that at least two induction coils (12; 16, 18) can be covered by a standard cooking vessel (14). Each induction coil (12; 16, 18) is connected to at least one induction generator being switched or switchable between a high power and a low power. Each induction generator is separately controllable, so that the induction coils (12; 16, 18) are switched or switchable between the high power and the low power. At least one control unit is provided for controlling the individual induction coils (12; 16, 18) according to a predetermined time pattern. Further, the present invention relates to a corresponding method for controlling the induction hob.

12 Claims, 1 Drawing Sheet

Figure 1:
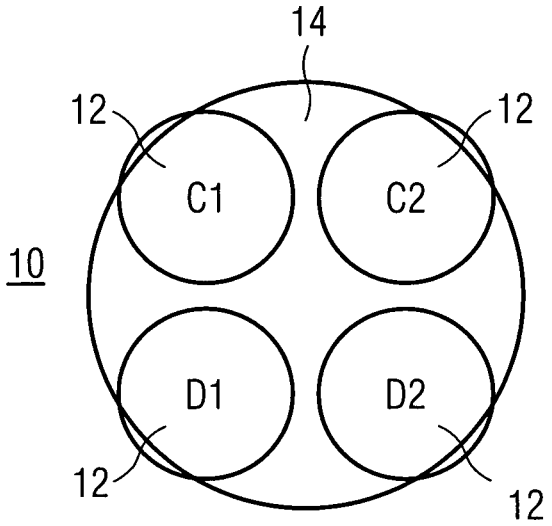

(58) Field of Classification Search
USPC ..... 219/622
IPC ..... H05B 6/06,6/12
See application file for complete search history.

(56) References Cited

U.S. PATENT DOCUMENTS 3,786,219 A * 1/1974 Kornrumpf et al. ..... 219/626
3,925,633 A * 12/1975 Partridge ..... H05B 6/065 219/625
4,151,387 A * 4/1979 Peters, Jr. ..... F24C 7/02 219/623
4,303,816 A * 12/1981 Goessler ..... A47J 27/62 219/431
4,426,564 A * 1/1984 Steigerwald ..... H02M 7/53803 219/624
4,785,147 A * 11/1988 Mucha ..... C21D 9/32 219/640
4,885,447 A * 12/1989 Sanchez Gonzalez ..... 219/626
5,227,597 A * 7/1993 Dickens et al. ..... 219/621
5,343,023 A * 8/1994 Geissler ..... H02M 7/4807 219/661
5,428,207 A * 6/1995 Essig ..... H05B 6/1254 219/622
6,043,471 A * 3/2000 Wiseman ..... H05B 6/06 219/639
6,498,325 B1 * 12/2002 Akel ..... H05B 6/065 219/624
7,425,690 B2 * 9/2008 Schilling ..... 219/451.1
9,540,991 B1 * 1/2017 Talbert ..... F02B 41/00
2002/0117497 A1 * 8/2002 Bassill ..... H05B 6/062 219/626
2004/0149736 A1 * 8/2004 Clothier ..... H05B 6/062 219/627
2006/0289489 A1 * 12/2006 Wang ..... 219/622
2007/0235445 A1 * 10/2007 Wilgen ..... H05B 6/101 219/635
2007/0262072 A1 * 11/2007 Schilling ..... H05B 3/746 219/451.1
2008/0087661 A1 * 4/2008 Haag ..... H05B 6/065 219/620
2009/0160413 A1 * 6/2009 Bogel ..... H05B 6/062 323/282
2009/0250454 A1 * 10/2009 Egenter ..... H05B 6/065 219/620
2010/0282740 A1 * 11/2010 Artigas Maestre .... H05B 6/065 219/662
2011/0240632 A1 * 10/2011 Anton Falcon ..... H05B 6/04 219/601

* cited by examiner

INDUCTION HOB AND A METHOD FOR CONTROLLING AN INDUCTION HOB

The present invention relates to an induction hob with a cooking surface and a number of induction coils within said cooking surface. In particular, present invention relates to an induction hob for household appliances. Further, the present invention relates to a method for controlling an induction hob with a cooking surface and a number of induction coils within said cooking surface.

Induction hobs, in particular for household appliances, become more and more popular. The inductions hob comprises a number of inductions coils arranged on a cooking surface. There are different arrangements for the cooking zones and the induction coils. The cooking surface may include one-size zones, multi-size zones and/or joined zones. It is requested by users that a cooking vessel may be located at different locations of the cooking surface.

In a typical induction hob one cooking zone may comprise one or two induction coils. If one cooking vessel covers one cooking zone, then the power is controlled by varying the frequency of an induction generator. For example, the power may be set at a value between 0 W and 4000 W.

If two cooking vessels cover two inductions coils, wherein one cooking vessel covers one induction coil in each case, then the control system regulates each induction coil and uses a power sharing, since two induction coils cannot run with full power at the same time. If one cooking vessel covers two inductions coils, then the control system regulates each induction coil and uses the power sharing, wherein the same power for each induction coil is provided.

It is an object of the present invention to provide an induction hob and a method for controlling an induction hob, which allow a simplified control of the inductions coils.

The object of the present invention is achieved by the induction hob according to claim 1.

According to the present the induction hob includes a cooking surface and a number of induction coils within said cooking surface, wherein:

- the induction coils are arranged on the cooking surface according to predetermined scheme, so that at least two induction coils can be covered by a standard cooking vessel,
- each induction coil is connected to at least one induction generator being switched or switchable between a high power and a low power,
- each induction generator is separately controllable, so that the induction coils are switched or switchable between the high power and the low power, and
- at least one control unit is provided for controlling the individual induction coils according to a predetermined time pattern.

The core idea of the present invention is that each single induction coil work at two fixed powers on the one hand and at least two inductions coils can be covered by a standard cooking vessel on the other hand. The power received by the cooking vessel is controlled by switching on and off the individual inductions coils below said cooking vessel. A continuous power spectrum for the single induction coil is not provided and not necessary.

According to a preferred embodiment of the present invention the power of the induction generator corresponds with a frequency, so that the selection of the frequency of the induction generator determines the power of the corresponding induction coil.

In particular, two fixed frequencies are provided for each induction generator.

Preferably, the induction coils on the cooking surface have the same sizes. This contributes to a production with low costs.

For example, the induction coils on the cooking surface are arranged in the form of a rectangular matrix.

Alternatively, the induction coils on the cooking surface are arranged in the form of a honeycomb. The honeycomb form allows a dense arrangement of induction coils on the cooking surface.

Preferably, the low power is between 10% and 20% of the high power.

The object of the present invention is also achieved by the method according to claim 8.

The method for controlling an induction hob according to the present invention is provided for an induction hob with a cooking surface and a number of induction coils with such sizes, that at least two induction coils can be covered by a standard cooking vessel, wherein each induction coil, which is completely or partially covered by the cooking vessel, is individually switched between a high power and a low power according to a predetermined time pattern by controlling induction generators, and each induction coil corresponds with at least one induction generator.

The main idea of the method according to the present invention is that each single induction coil is activated at two fixed powers on the one hand and at least two inductions coils are covered by a standard cooking vessel on the other hand. The power received by the cooking vessel is controlled by switching on and off the individual inductions coils below said cooking vessel.

In particular, the selection of a frequency of the induction generator determines the power of the corresponding induction coil.

Preferably, two fixed frequencies are provided for each induction generator.

According to a preferred embodiment of the present invention the low power is between 10% and 20% of the high power.

Novel and inventive features of the present invention are set forth in the appended claims.

Figure 2:
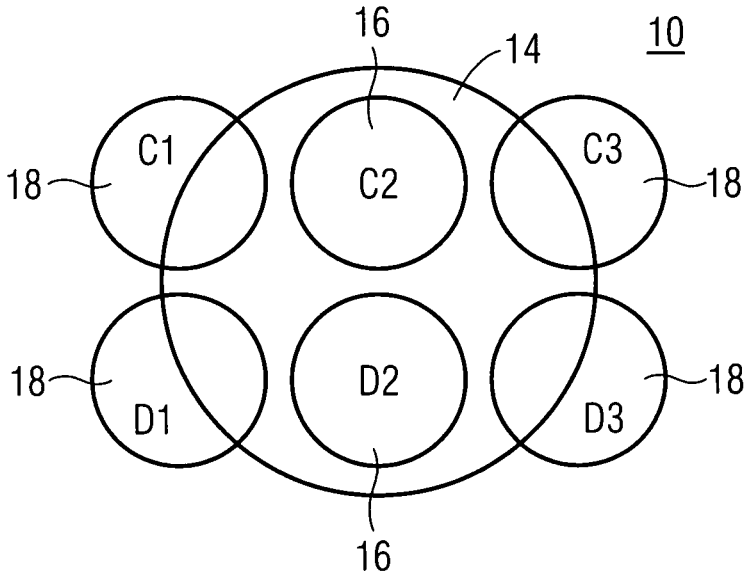

The present invention will be described in further detail with reference to the drawings, in which FIG. 1 illustrates a schematic top view of an arrangement of four inductions coils within a cooking surface of an induction hob according to a first embodiment of the present invention, and FIG. 2 illustrates a schematic top view of an arrangement of six inductions coils within the cooking surface of the induction hob according to a second embodiment of the present invention.

FIG. 1 illustrates a schematic top view of an arrangement of four inductions coils 12 within a cooking surface 10 of an induction hob according to a first embodiment of the present invention. In this example, each induction coil has either a fixed power of 500 W or two possible powers of 500 W and 80 W.

The four inductions coils 12 are arranged on the cooking surface 10. Said inductions coils 12 form a square. A cooking vessel 14 with a circular bottom side is put on the cooking surface 10. The cooking vessel 14 covers all four inductions coils 12 completely. In this example, the cooking vessel 14 may receive a maximum power of 2000 W, since each of the induction coils has a power of 500 W.

The power provided for the cooking vessel 14 may be controlled by creating a rotating effect. During said rotating effect the induction coils 12 are alternating activated and deactivated. Said rotating effects avoid that some of the induction coils 12 are continuously activated and the remaining induction coils 12 are deactivated the whole time.

If the user requires a power of 1500 W, then three of the four induction coils 12 are activated simultaneously.

The cooking process is timely subdivided into a plurality of identical cooking cycles. In this embodiment each cooking cycle comprises four time intervals.

The following table shows an example of a cooking cycle with a power of 1500 W. The four induction coils are denoted as C1, C2, D1 and D2, respectively, wherein the letters represent the lines and the numbers represent the columns of the induction coils on the cooking surface.

| | $1^{st}$ interval | $2^{nd}$ interval | $3^{rd}$ interval | 4th interval |
|---|---|---|---|---|
| C1 | X | | X | X |
| C2 | X | X | | X |
| D1 | X | X | X | |
| D2 | | X | X | X |

During a first interval the inductions coils C1, C2 and D1 are activated and the induction coil D2 is deactivated. In a second interval the inductions coils C2, D1 and D2 are activated and the induction coil C1 is deactivated. In a following third interval the inductions coils C1, D1 and D2 are activated and the induction coil C2 is deactivated. During a last fourth interval the inductions coils C1, C2 and D2 are activated and the induction coil D1 is deactivated.

Please note, if the each induction coil 12 has the fixed power of 500 W, then the deactivated induction coils 12 run with the power of 0 W in each case. However, if the each induction coil 12 has the two possible powers of 500 W and 80 W, then the "deactivated" induction coils 12 run with the power of 80 W in each case.

In a similar way, if a power of 1000 W is requested by the user, then only two induction coils 12 are activated in the same interval. The remaining induction coils 12 are deactivated and run with the power of 80 W or 0 W, respectively.

Further, if a power of 1250 W is requested by the user, then two induction coils 12 are activated during two intervals and three induction coils 12 are activated during the other two intervals. Preferably, the intervals with two and three activated inductions coils 12 are alternating.

In general, each induction coil 12 can operate with two fixed power values. Power values other than said fixed values are not provided. This allows induction generators with less complexity. In this example each induction coil 12 is connected to at least one induction generator. The induction generators are not shown. The induction generators are controlled by a control unit, which is also not shown. The power of the induction coil 12 is set by a corresponding frequency of the induction generator. For example, a high power for the induction coil 12 corresponds with a frequency of about 20 kHz and a low power for the induction coil 12 corresponds with a frequency of about 40 kHz.

FIG. 2 illustrates a schematic top view of an arrangement of six induction coils 16 and 18 within the cooking surface 10 of the induction hob according to a second embodiment of the present invention. This embodiment is advantageous, if a relative low power is requested by the user and the cooking vessel 14 covers several induction coils 16 and 18. Each induction coil 16 and 18 is connected to at least one induction generator controlled by the control unit. The induction generators and the control unit are not shown.

The six induction coils 16 and 18 are arranged by three columns and two lines on the cooking surface 10. The induction coils 16 and 18 are denoted as C1, C2, C3, D1, D2 and D3, respectively, wherein the lines are represented by the letters and the columns are represented by the numbers. The two induction coils of the second column are defined as central induction coils 16. The four induction coils of the first and third columns are defined as lateral induction coils 18. The cooking vessel 14 covers the central induction coils 16 completely and the lateral induction coils 18 only partially.

Since the lateral induction coils 18 are not covered completely, it is convenient that the central induction coils 16 are activated with a high power and the lateral induction coils 16 are activated with a low power.

The two fixed powers of each induction coil 12, 16 and 18 allow an induction generator with low complexity. Since the inductions coils 12, 16 and 18 have such a size, that the cooking vessel 14 covers at least two inductions coils 12 and 16, the number of possible power values increases with the number of inductions coils 12, 16 and 18 covered by the cooking vessel 14.

A power sharing can be realized for the inductions coils 12, 16 and 18 covered by the cooking vessel 14. During said power sharing the power under the cooking vessel 14 depends on the location as well as on time. The induction generators may be switched on and off within a very short time interval, so that a quasi-continuous spectrum of the whole power of the inductions coils 12, 16 and 18 covered by the cooking vessel 14 may be realized.

Although illustrative embodiments of the present invention have been described herein with reference to the accompanied drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking surface
12 induction coil
14 cooking vessel
16 central induction coil
18 lateral induction coil
C1 number of an induction coil
C2 number of an induction coil
C3 number of an induction coil
D1 number of an induction coil
D2 number of an induction coil
D3 number of an induction coil

The invention claimed is:

1. An induction hob comprising:

a cooking surface (10);

a number of induction coils (12; 16; 18), wherein the induction coils (12; 16; 18) are arranged on the cooking surface (10) according to a predetermined scheme, wherein at least two of the induction coils (12; 16; 18) can be covered by a cooking vessel (14), each induction coil (12; 16; 18) is connected to at least one induction generator configured to be switched between a high power and a low power, wherein the low power is between 10% and 20% of the high power, each induction generator is separately controllable, wherein each of the induction coils (12; 16; 18) is configured to be separately switched between the high power and the low power, and at least one control unit is provided for controlling each of the induction generators by switching each of the induction coils (12; 16; 18) between a high power and a low power according to a predetermined time pattern, wherein the power received by the cooking vessel (14) is controlled by switching each of the induction coils (12; 16; 18) below the cooking vessel (14) between the high power and the low power depending on the required power under the cooking vessel (14) such that at least one of the induction coils (12; 16; 18) below the cooking vessel (14) operates at the high power during a cooking period at the same time as at least one of the induction coils (12; 16; 18) operates at the low power.

2. The induction hob according to claim 1, characterized in, that the power of the induction generator corresponds with a frequency, wherein the selection of the frequency of the induction generator determines the power of the corresponding induction coil (12; 16; 18).

3. The induction hob according to claim 1, characterized in, that two fixed frequencies are provided for each induction generator.

4. The induction hob according to claim 1, characterized in, that the induction coils (12; 16; 18) on the cooking surface (10) have the same sizes.

5. The induction hob according to claim 1, characterized in, that the induction coils (12; 16; 18) on the cooking surface (10) are arranged in the form of a rectangular matrix.

6. The induction hob according to claim 1, characterized in, that the induction coils (12; 16; 18) on the cooking surface (10) are arranged in the form of a honeycomb.

7. A method for controlling an induction hob including a cooking surface (10) and a number of induction coils (12; 16; 18), comprising the steps of:

arranging induction coils (12; 16; 18) on the cooking surface (10) according to a predetermined scheme, wherein at least two of the induction coils (12; 16; 18) can be completely or partially covered by a cooking vessel (14), connecting each of the induction coils (12; 16; 18) to at least one induction generator configured to be switched between a high power and a low power, wherein the low power is between 10% and 20% of the high power, controlling separately each induction generator, wherein each of the induction coils (12; 16; 18) is configured to be separately switched between the high power and the low power, switching separately each of the induction coils (12; 16; 18) between the high power and the low power according to a predetermined time pattern, wherein the power received by the cooking vessel (14) is controlled by switching each of the induction coils (12; 16; 18) below the cooking vessel (14) between the high power and the low power depending on the required power under the cooking vessel (14) such that at least one of the induction coils (12; 16; 18) below the cooking vessel (14) operates at the high power during a cooking period at the same time as at least one of the induction coils operates at the low power.

8. The method according to claim 7, characterized in, that the selection of a frequency of the induction generator determines the power of the corresponding induction coil (12; 16; 18).

9. The method according to claim 7, characterized in, that two fixed frequencies are provided for each induction generator.

10. The method according to claim 7, wherein the cooking period is subdivided into a plurality of identical time cycles equal to the number of the induction coils (12; 16; 18) below the cooking vessel (14) and the switching each of the induction coils (12; 16; 18) according to the predetermined time pattern includes switching each of the induction coils below the cooking vessel (14) between the high power and the low power for an equal number of the time cycles.

11. The method according to claim 7, wherein the cooking period is subdivided into a plurality of identical time cycles, each of said identical time cycles comprising a number of time intervals equal to the number of the induction coils (12; 16; 18) below the cooking vessel (14), wherein the power received by the cooking vessel (14) is provided by rotating the switching of each of the induction coils (12; 16; 18) between the high power and the low power such that each of the induction coils is switched between the high power and the low power for an equal number of time intervals.

12. A method for controlling an induction hob including a cooking surface (10) and a number of induction coils (12; 16; 18), comprising the steps of:

arranging induction coils (12; 16; 18) on the cooking surface (10) according to a predetermined scheme, wherein at least two of the induction coils (12; 16; 18) can be covered completely or partially by a cooking vessel (14), connecting each of the induction coils (12; 16; 18) to at least one induction generator configured to be switched between a high power and a low power, wherein the low power is between 10% and 20% of the high power, controlling separately each induction generator, wherein each of the induction coils (12; 16; 18) is switched separately between the high power and the low power, dividing a cooking period into a plurality of identical time cycles, each of said identical cooking cycles comprising a number of time intervals equal to the number of the induction coils (12; 16; 18) below the cooking vessel (14), controlling the power received by the cooking vessel (14) by rotating the number of the induction coils (12; 16; 18) that are activated and deactivated under the cooking vessel (14) during each of the time intervals depending on the required power under the cooking vessel (14), such that each of the induction coils (12; 16; 18) is activated and deactivated for an equal number of time intervals during the cooking period, wherein each of the induction coils (12; 16; 18) below the cooking vessel (14) is activated when switched at the high power and each of the induction coils (12; 16; 18) below the cooking vessel (14) is deactivated when switched at the low power.

* * * * *